US007922035B2

(12) United States Patent
Long et al.

(10) Patent No.: US 7,922,035 B2
(45) Date of Patent: Apr. 12, 2011

(54) TISSUE STACK AND DISPENSER

(75) Inventors: Leslie Thomas Long, Appleton, WI (US); Jon Christensen, Oshkosh, WI (US); Craig A. Blodgett, Buckfield, ME (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 765 days.

(21) Appl. No.: 11/635,877

(22) Filed: Dec. 7, 2006

(65) Prior Publication Data

US 2008/0135571 A1 Jun. 12, 2008

(51) Int. Cl.
*A47K 10/24* (2006.01)

(52) U.S. Cl. ..... 221/48; 221/45

(58) Field of Classification Search ..... 221/33, 221/34, 38, 44, 45, 46, 47, 48, 49, 50, 51, 221/63, 67, 70, 92, 155, 176, 240, 302, 303
See application file for complete search history.

(56) References Cited

U.S. PATENT DOCUMENTS

| | | | | | |
|---|---|---|---|---|---|
| 896,510 | A | * | 8/1908 | Baruch | 221/51 |
| 1,173,284 | A | * | 2/1916 | Leiman | 229/4.5 |
| 2,195,622 | A | | 4/1940 | Fourness et al. | |
| 2,656,916 | A | * | 10/1953 | Henderson | 221/50 |
| 3,369,700 | A | | 2/1968 | Nelson | |
| 3,881,632 | A | * | 5/1975 | Early et al. | 221/50 |
| 4,413,769 | A | | 11/1983 | Michetti | |
| D374,143 | S | * | 10/1996 | Owens | D6/522 |
| 5,669,549 | A | * | 9/1997 | Robertson | 229/4.5 |
| 5,979,700 | A | | 11/1999 | Suess | |
| 5,980,931 | A | | 11/1999 | Fowler et al. | |
| 6,121,165 | A | | 9/2000 | Mackey et al. | |
| 6,213,345 | B1 | * | 4/2001 | Plank | 221/46 |
| 6,250,495 | B1 | * | 6/2001 | Bando | 221/48 |
| 6,286,712 | B1 | * | 9/2001 | Craig et al. | 221/48 |
| D464,877 | S | * | 10/2002 | Weinstein et al. | D9/418 |
| 6,543,643 | B2 | * | 4/2003 | Iida et al. | 221/48 |
| 6,595,386 | B2 | * | 7/2003 | Vogel et al. | 221/48 |
| 6,685,050 | B2 | * | 2/2004 | Schmidt et al. | 221/48 |
| 7,213,807 | B2 | * | 5/2007 | Blanchard et al. | 270/58.32 |
| 2003/0116581 | A1 | * | 6/2003 | Schmidt et al. | 221/49 |
| 2004/0016907 | A1 | | 1/2004 | Shi | |
| 2004/0115393 | A1 | * | 6/2004 | Vogel et al. | 428/121 |
| 2006/0131319 | A1 | | 6/2006 | McDonald | |
| 2007/0062967 | A1 | * | 3/2007 | Zaidman et al. | 221/48 |

* cited by examiner

*Primary Examiner* — Gene Crawford
*Assistant Examiner* — Kelvin L Randall, Jr.
(74) *Attorney, Agent, or Firm* — R. Joseph Foster, III

(57) ABSTRACT

By controlling the profile of a folded stack when placed into an oval dispenser, it is possible to reduce the compression of the folded stack by the dispenser's sidewall, thereby reducing or eliminating sheet tears when dispensing the sheet-material from the dispenser. In particular, by making the folded stack thicker in the middle and thinner at the edges, as a result of providing a variable width flat stack prior to folding the flat stack, the folded stack will better fit into an oblong or circular dispenser.

10 Claims, 16 Drawing Sheets

TISSUE STACK AND DISPENSER

BACKGROUND

Increasingly, producers of sheet dispensers, such as facial tissue cartons, are interested in alternative shapes besides the typical parallelepiped shapes generally offered. A parallelepiped (rectangular prism) dispenser shape can offer several advantages, such as efficient packing of the product, efficient distribution of the product, and efficient board utilization to make the carton. However, consumers have grown accustomed to such shapes and there is little differentiation from one product to another. Graphical treatments can help, but the basic dispenser shapes are still largely the same for all manufacturers.

One common tissue dispenser is an upright carton having a cubical shape containing an inverted U-shaped, V-folded, interleaved stack of facial tissues. An upright carton typically has a square top and bottom having dimensions of approximately 4.4 inches by 4.4 inches. The height of the upright tissue carton is approximately 5 inches. When this tissue packaging was first introduced by Kimberly-Clark Corporation many years ago, it was a unique and differentiated packaging format to the traditional flat, rectangular tissue cartons. As such, it drove consumer interest, enabling Kimberly-Clark Corporation to offer the packaging format as a premium product. Patent protection for the upright tissue carton and the tissue stack folding method has expired, enabling many other manufacturers to enter the market.

Alternatively shaped tissue dispensers to the ubiquitous flat or upright tissue cartons could offer an advantage in product differentiation. Alternatively shaped tissue dispensers could be offered as a new premium product and upright tissue dispensers as a mid-tier product. However, alternatively shaped dispensers are typically not as well suited to the size of standard tissue stacks, which often fit better and dispense better from the traditional shapes. For example, dispensers having an oval cross section can provide a distinctive look, but the depth of the oval dispenser as measured from the front face can be less than the 4.4 inch depth in an upright tissue carton. The decreased depth can significantly reduce the number of sheets that can fit into the oval dispenser and/or cause dispensing problems (sheet tears, multiple dispensing, and sheet fallback) when dispensing. Dispensing problems can cause a perception of poor quality in the mind of the user/purchaser, making it more difficult to position an oval shaped dispenser as a premium product.

Therefore, a need exists for dispenser shapes that are significantly differentiated from existing upright or rectangular tissue carton shapes; yet, at the same time, can dispense tissue stacks as well or better than current upright or rectangular dispensers for a similar sheet count stack. Furthermore, a need exists for packaging the same number of tissue sheets in an oval or circular dispenser as currently placed into existing upright dispensers without increasing the incidence of dispensing failures.

SUMMARY

The inventors have discovered that by controlling the profile of the folded stack when placed into an oval or circular dispenser, it is possible to reduce the compression of the folded stack by the dispenser's sidewall, thereby reducing or eliminating sheet tears when dispensing the sheet-material from the dispenser. In particular, by making the folded stack thicker in the middle and thinner at the edges, the folded stack will better fit into an oblong dispenser having an oval top and bottom.

Hence, in one aspect, the invention resides in a product including: a flat stack of a plurality of folded sheets formed from a sheet-material, the flat stack having a variable width and a substantially uniform length, the flat stack having an upper portion and a lower portion; the flat stack folded about a transverse fold axis to form a folded stack having an arched stack top and a stack bottom comprising two legs; and the folded stack placed into a dispenser.

BRIEF DESCRIPTION OF THE DRAWINGS

The above aspects and other features, aspects, and advantages of the present invention will become better understood with regard to the following description, appended claims, and accompanying drawings in which:

Figure 1:
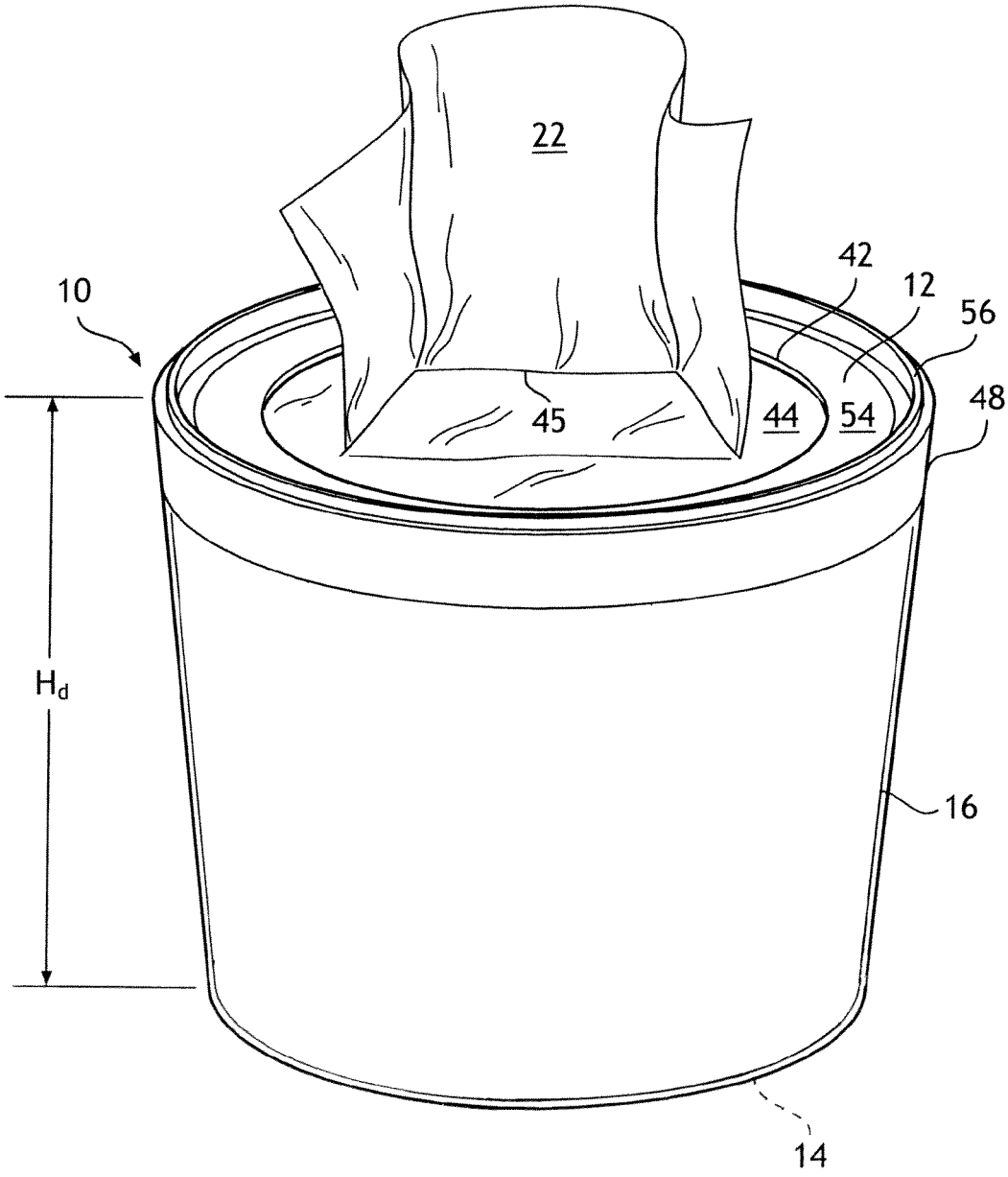
FIG. 1 is a perspective view showing one embodiment of the sheet-material dispenser of the present invention.

Repeated use of reference characters in the specification and drawings is intended to represent the same or analogous features or elements of the invention in different embodiments.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet-material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; conform substrates comprising cellulose fibers and polymer fibers; wet substrates such as wet wipes, moist cleaning wipes, moist toilet paper wipes, and baby wipes; film or plastic substrates such as those used to wrap food; and shop towels. Furthermore, laminated or plied together substrates of two or more layers of any of the preceding substrates are also suitable.

As used herein, "wet sheet-material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate, issued to Fowler et al. on Nov. 9, 1999. Other suitable wet sheet-materials can have encapsulated ingredients such that the capsules rupture during dispensing or use. Other suitable wet sheet-materials include dry substrates that deliver liquid when subjected to in-use shear and compressive forces. Such substrates are disclosed in U.S. Pat. No. 6,121,165 entitled Wet-Like Cleaning Articles, issued to Mackay et al. on Sep. 19, 2000.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
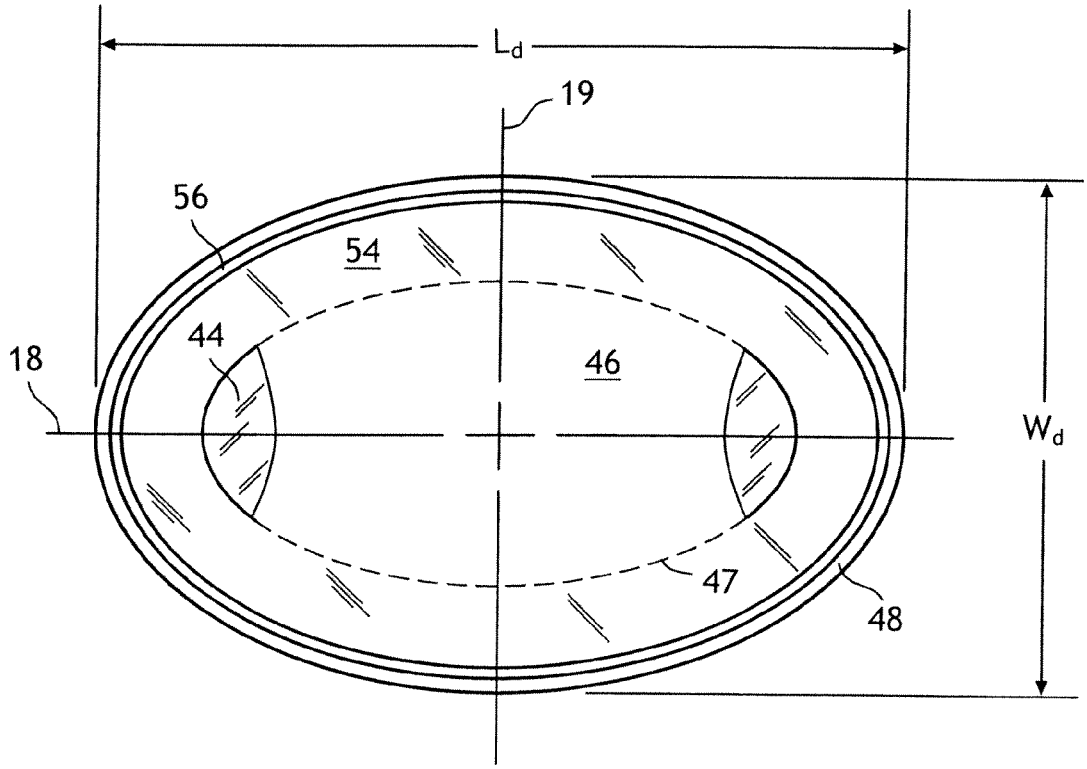
FIG. 2 is a top view of FIG. 1 prior to opening the sheet-material dispenser.

Referring now to FIGS. 1 and 2, one embodiment of an oblong dispenser 10 is illustrated. The dispenser includes a top 12, a bottom 14, and a sidewall 16. The dispenser has a maximum length, Ld, measured along a dispenser longitudinal axis 18, and a maximum width, Wd, measured along a dispenser transverse axis 19. The dispenser is oblong with the dimension for Ld greater than the dimension for Wd. As used herein, "maximum" for a length, width, or height dimension is used to refer to the greatest dimension of the object in that specific direction when the shape of the object is such that it has a variable length, width, or height from the use of curved or tapered portions, for example. Maximum does not mean that the dimension referred to may not exceed a given dimension. Another embodiment of the object may have a different maximum length, width, or height.

In one embodiment of the oblong dispenser, the top and the bottom (12, 14) comprised an oval shape and the oval dispenser had a maximum length, Ld, of 5 and ⅞ inches and a maximum width, Wd, of 3 and ⅞ inches. An oval sheet-material dispenser is a visually striking and an alternatively shaped dispenser to the square or rectangular facial tissue boxes currently offered. In other embodiments of the dispenser, at least a portion of the sidewall 16 can be curved such as a racetrack dispenser having a curvilinear sidewall 16 with curved end portions and linear front and back faces. Such a dispenser from the top resembles a speed skating ice rink. In another embodiment, the entire sidewall 16 can be curved with the sidewall 16 not having any linear portions. In other embodiments, the oblong dispenser can have four substantially flat sidewall panels connected by curved sections or the oblong dispenser can be an elongated hexagonal shape, or other polygon shape.

Referring now to FIGS. 3, 3A, 3B, and 3C, a flat stack 20 of a plurality of individual folded sheets 22 of a sheet material 24 having substantially the same unfolded sheet width is illustrated. The flat stack 20 has a substantially uniform maximum length, Ls, measured along a stack longitudinal axis 26, and a variable width, W, measured in the direction of a stack transverse fold axis 28. In particular, an upper portion 29 of the flat stack 20 has a smaller width, Wu, than a lower portion 30 of the flat stack. The difference between the widths of Wu and Wl can be created by folding the same width sheets 22 along the longitudinal axis in the upper portion 29 with more folds than the number of folds along the longitudinal axis for the sheets in the lower portion 30. For example, the sheets 22 in the upper portion 29 could be W-folded and the sheets in the lower portion 30 Z-folded or V-folded. Alternatively, the upper portion 29 could be Z-folded and the lower portion 30 could be V-folded.

Figure 3:
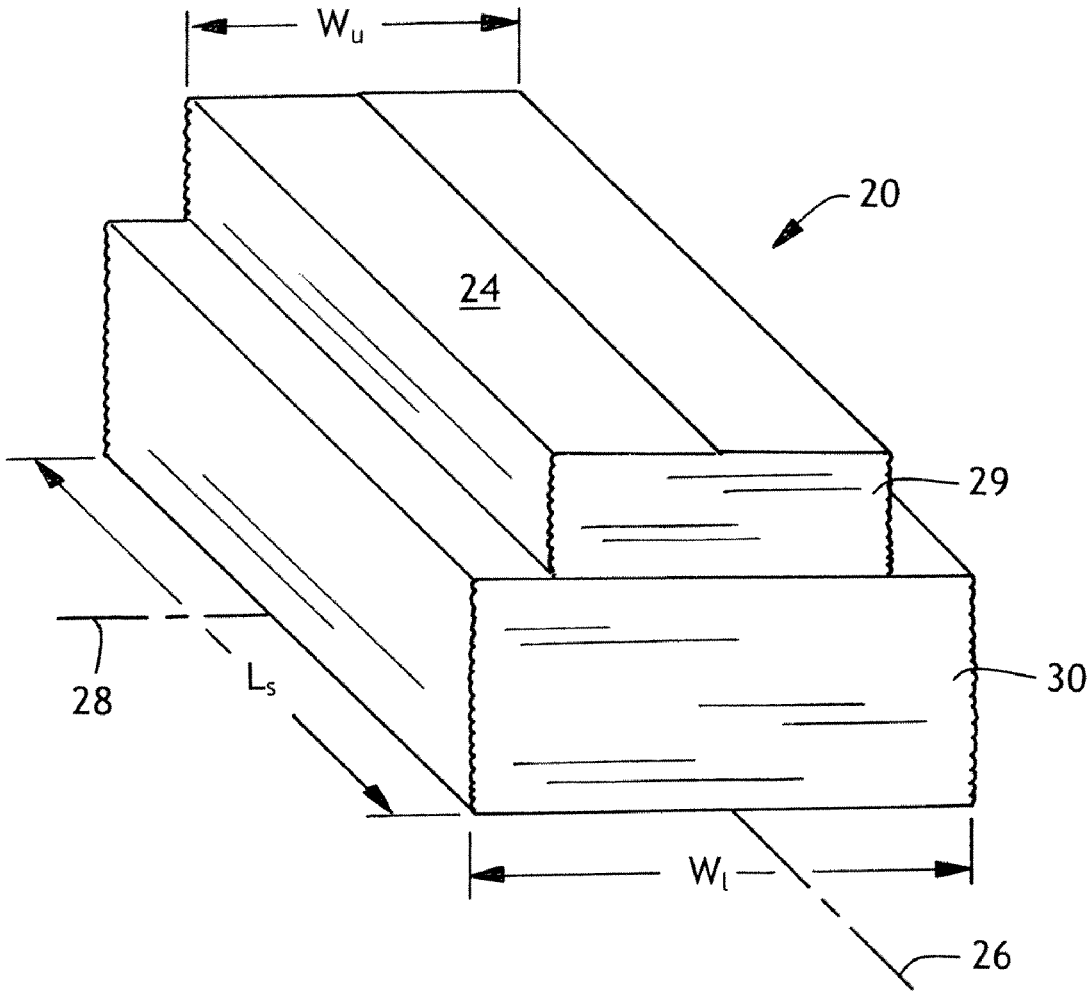
FIG. 3 is a perspective view of one embodiment of a stack containing a plurality of sheets formed from a sheet-material.
Figure 3A:
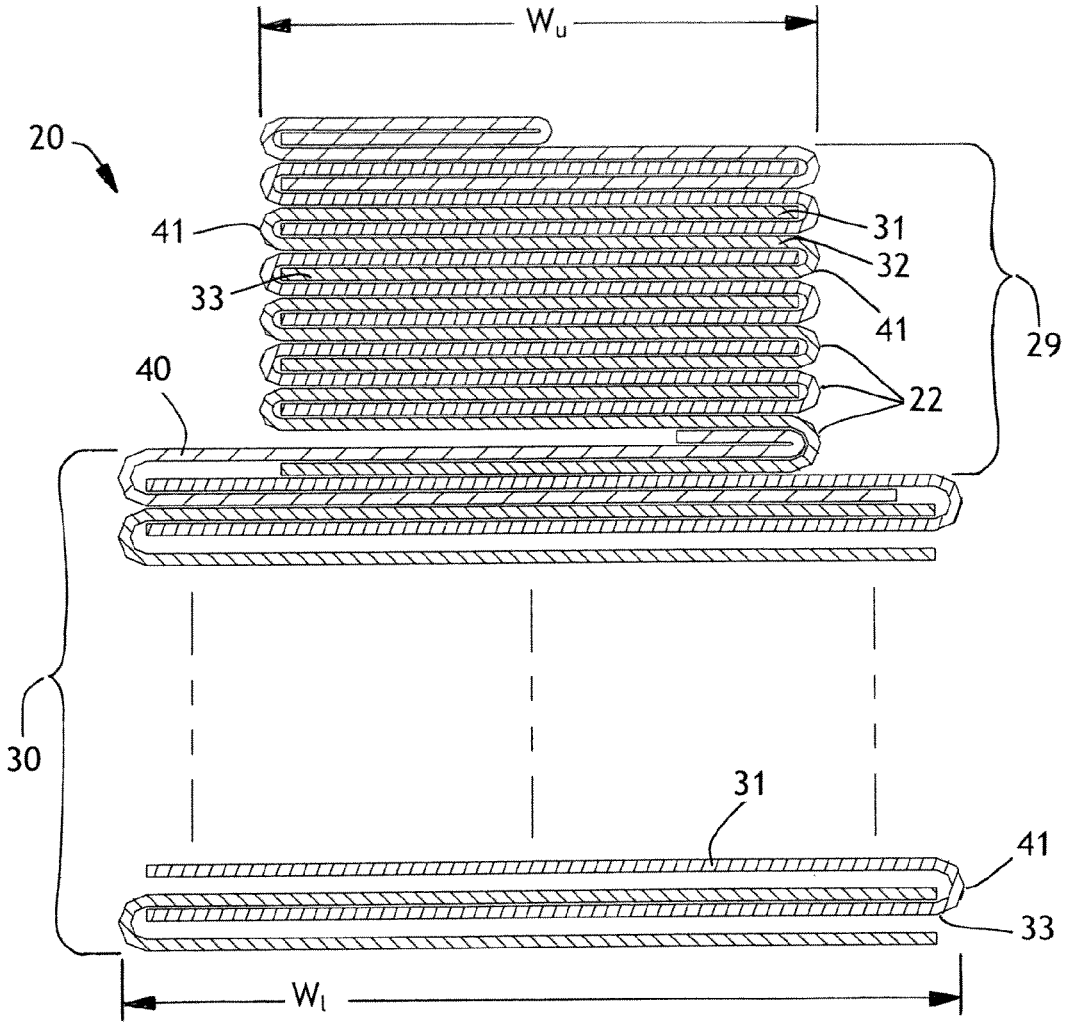
FIG. 3A is a partially exploded end view of the stack of FIG. 3 showing a fold configuration for the plurality of sheets.

In one embodiment as best seen in FIG. 3A, the flat stack 20 contained individual tissue paper sheets 22 that are folded and interleaved for pop-up dispensing. During pop-up dispensing, withdrawing one sheet from the dispenser pulls at least a portion of the next sheet out of the dispenser for easier access to the next sheet. In the illustrated embodiment, the upper portion 29 of the flat stack 20 includes a plurality of Z-folded sheets having a leading panel 31, a center panel 32, and a trailing panel 33 separated by two fold lines 41. The leading panel 31, center panel 32, and trailing panel 33 are approximately equal in width. The Z-folded sheets are interleaved, with the leading panel 31 of a subsequent sheet placed between the center panel 32 and the trailing panel 33 of a preceding sheet. The lower portion 30 of the flat stack includes a plurality of V-folded sheets having a leading panel 31 and a trailing panel 33 separated by a fold line 41. The V-folded sheets are interleaved, with the leading panel 31 of a subsequent sheet placed between the leading panel 31 and trailing panel 33 of a preceding sheet. The leading panel 31 and trailing panel 33 are approximately equal in width. At the interface between the upper portion 29 and the lower portion 30, the transition sheet 40 is Z-folded with a shorter leading panel 31 and longer center and trailing panels (32, 33) to smoothly transition from the upper Z-fold to the lower V-fold.

Figure 3B:
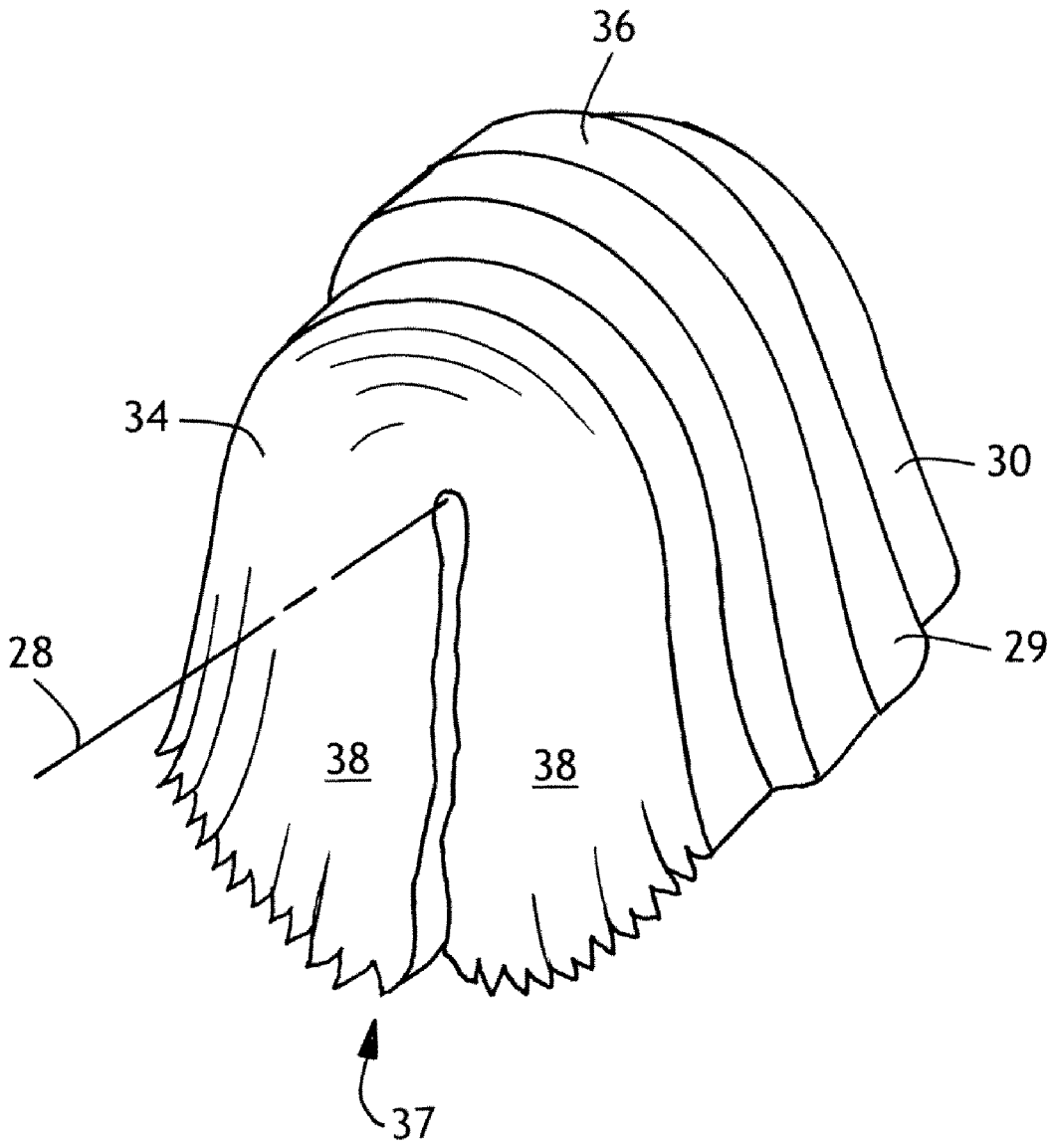
FIG. 3B is a perspective view of the stack of FIG. 3 folded about a transverse fold axis.
Figure 3C:
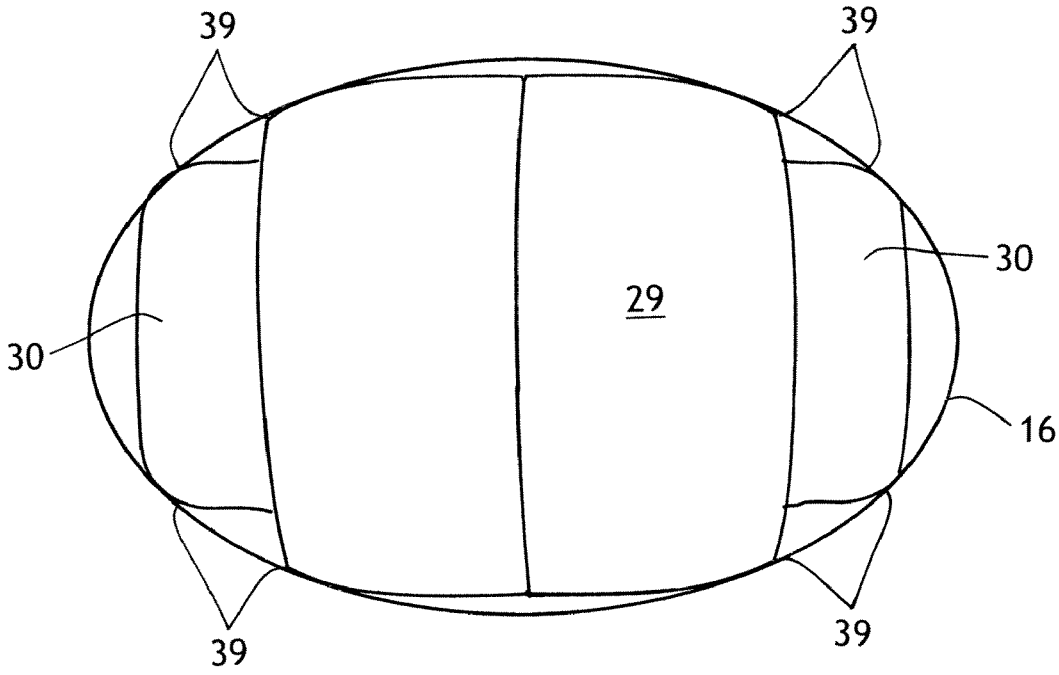
FIG. 3C is a top view of the sheet-material dispenser of FIG. 1 with the top removed and the folded stack of FIG. 3B inserted into the dispenser.

Referring to FIGS. 3B, 3C, and 2, after assembling the flat stack 20 of interfolded sheets 22, the flat stack is folded approximately 180 degrees about the stack transverse fold axis 28 adjacent the lower portion 30 to form a folded stack 34 having an arched stack top 36 and a stack bottom 37 comprising two opposing legs 38 located on opposite sides of the transverse fold axis 28 and extending there from. The folded stack 34 is then inserted into the oval dispenser 10 such that the transverse fold axis 28 is substantially parallel to the dispenser longitudinal axis 18 with the stack bottom 37 adjacent the dispenser bottom 14.

As seen in FIG. 3C, this results in the folded stack 34 substantially filling out the interior length and width of the oval dispenser 10 without the folded stack 34 being unduly compressed by the oval dispenser's sidewall 16. Since the upper portion 29 of the folded stack 34 is narrower, it fills in the wider center section of the oval dispenser 10. The thickness of the folded stack 34 is reduced near the narrower end portions of the oval dispenser 10 thereby reducing compression while dispensing the initial sheets; especially at the edges 39 of the folded stack 34 where the fold lines 41 are located. Sheet-material 24 that would have been excessively compressed at the edges 39 has been relocated to the wider center section of the oval dispenser. As such, improved dispensing occurs because the initial sheets in the folded stack are compressed much less by the oval sidewall 16 when the same number and equivalent thickness sheets comprise the folded stack 34 as opposed to the same number of sheets formed into an entirely V-folded interleaved folded stack 34.

It is believed one of the primary causes of sheet dispensing failures in oval dispensers containing folded stacks 34 is tearing of the initial sheets upon withdrawing them from the dispenser. Sheet tears are believed to occur by attempting to place too many individual sheets in the folded stack 34, thereby increasing its overall size such that it must be significantly compressed by the sidewall 16 in order to fit into the oval dispenser 10. As such, increasing the size of the dispensing opening 42 (see FIG. 1) or increasing the maximum height of the oval dispenser are not effective measures for reducing sheet tears as sheet counts are increased in an oval dispenser containing a folded stack 34.

As used herein, the interleaved distance is the contact distance as measured in the width direction of a following sheet that touches one or more panels of a preceding sheet. Referring to FIG. 3A, the interleaved distance of the sheets 22 in the upper portion 29 is approximately equal to the width of the leading panel 31 or approximately equal to Wu. The interleaved distance of the sheets 22 in the lower portion 30 is approximately equal to the width of the leading panel 31 or approximately equal to W1. As such, the interleaved distance varies from the upper portion 29 to the lower portion 30. In particular, the interleaved distance for the upper portion 29 is less than the interleaved distance for the lower portion 30. It is believed improved dispensing can occur by reducing the interleaved distance for the upper portion 29. By having less interleaved distance, it can be easier to remove a sheet from upper portion 29 when the folded stack 34 is placed into the oval dispenser 10. With too much interleaved distance, the compressive forces from the sidewall 16 acting on the folded stack 34 can cause the sheet to tear during removal from the dispenser. The total frictional force generated by the interleaved contact can exceed the tear strength of the sheet. By reducing the interleaved distance, sheet tears can be reduced while maintaining acceptable pop-up dispensing of the sheets 22 in the upper portion 29.

In various embodiments, the upper portion 29 comprises at least 6 folded sheets, preferably 8 folded sheets or more, or more preferably 10 folded sheets or more. If the number of folded sheets in the upper portion 29 becomes too great, the thickness of the folded stack 34 can become too large, increasing the compression on the folded stack 34 by the sidewall 16 of the oval dispenser 10 in the center portion of the oval dispenser. Therefore, the upper portion 29 comprises about 30 folded sheets or less, or about 20 folded sheets or less. The upper portion 29 can comprise any range of the stated number of sheets such as from about 6 to about 30, or about 8 to about 20 folded sheets. Alternatively, for an oval shaped dispenser, the number of the individual folded sheets in the upper portion 29 divided by the total number of individual folded sheets in the flat stack 20 (upper portion 29+lower portion 30), expressed as a percentage, can be between about 0.5 percent to about 25 percent, or between about 0.5 percent to about 20 percent, or between about 0.5 percent to about 15 percent for the upper portion 29.

For an oval dispenser 10 having a maximum width, Wd, of approximately 3 and ⅞ inches and a maximum length, Ld, of 5 and ⅞ inches, the ratio of the number of the individual folded sheets in the upper portion 29 compared to the number of individual folded sheets in the lower portion 30 can be calculated based on compressing each portion of the folded stack 34 to the same extent by the sidewall 16 of the dispenser 10. In one embodiment, the sheets in the upper portion 29 are folded into three panels and the sheets in the lower portion 30 are folded into two panels. If the unfolded sheet width is approximately 8.4 inches, the edges 39 where the lower portion 30 touches the sidewall 16 is approximately 1.27 inches above the carton longitudinal axis 18. The edges 39, where the upper portion 29 touches the sidewall 16, are approximately 1.65 inches above the carton longitudinal axis 18, or approximately 0.37 inches above the edges 39 of the lower portion 30. When the number of sheets in the lower portion 30 is represented by $n_1$ and the number of sheets in the upper portion 29 is represented by $n_2$, then, for equivalent compression at all edges 39 by the sidewall 16, $2n_1=1.27$ and $3n_2=0.37$. Solving for the ratio of the number of sheets in the upper portion to the number of sheets in the lower portion, $n_2/n_1$=approximately 0.19. Therefore, if 70 sheets were desired in the lower portion 30, the number of sheets in the upper portion 29 to have approximately the same sidewall compression for each portion would be 70 multiplied by 0.19 or approximately 13 sheets.

Figure 4:
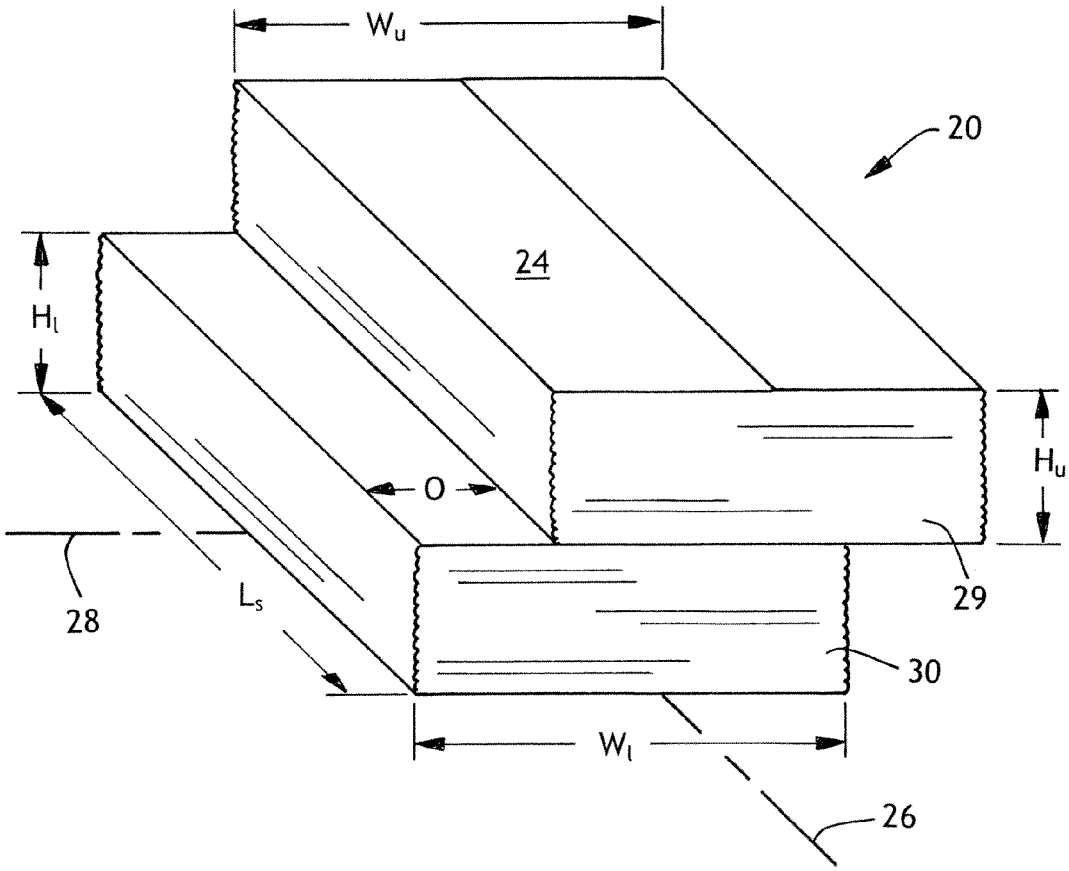
FIG. 4 is a perspective view of another embodiment of a stack containing a plurality of sheets formed from a sheet-material.
Figure 4A:
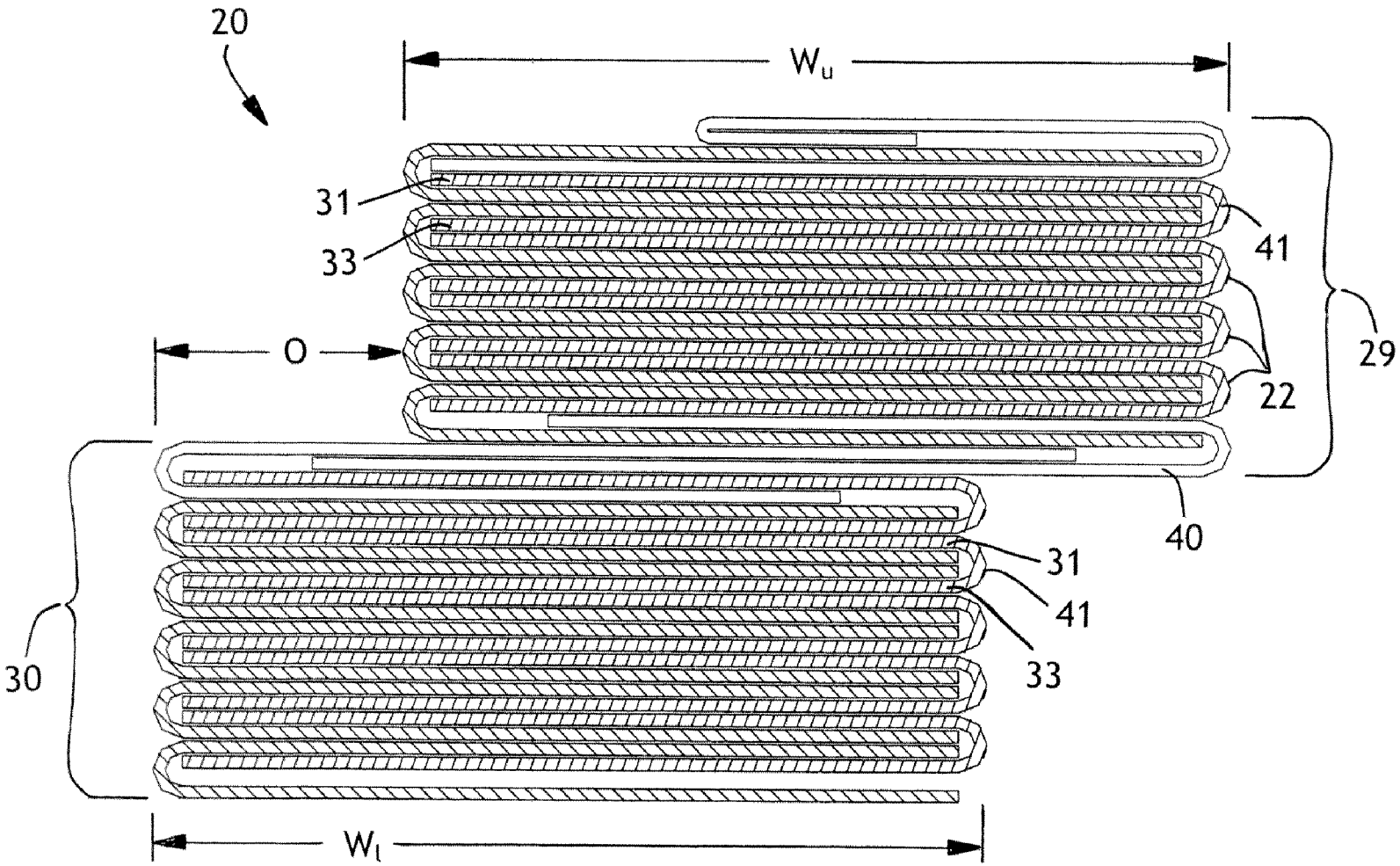
FIG. 4A is a partially exploded end view of the stack of FIG. 4 showing a fold configuration for the plurality of sheets.
Figure 4B:
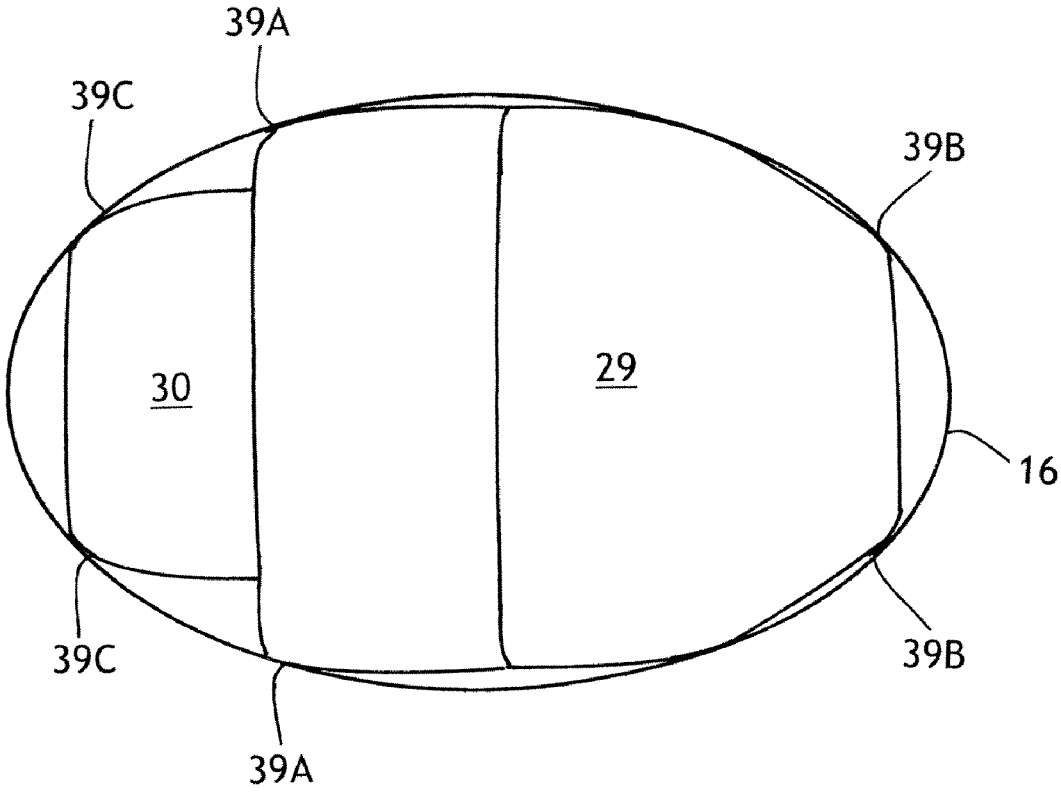
FIG. 4B is a top view of the sheet-material dispenser of FIG. 1 with the top removed and the stack of FIG. 4 folded about a transverse fold axis and inserted into the dispenser.

Referring now to FIGS. 4, 4A, and 4B, a flat stack 20 of a plurality of individual folded sheets 22 of a sheet material 24 having substantially the same unfolded sheet width is illustrated. The flat stack 20 has a substantially uniform maximum length, Ls, measured along a stack longitudinal axis 26, and a variable width, W, measured in the direction of a stack transverse fold axis 28. In particular, an upper portion 29 of the flat stack 20 is offset a distance of O from the lower portion 30 of the flat stack. As such, the width of the flat stack 20, where the upper portion 29 contacts the lower portion 30, is wider than the width of the upper portion, Wu. In this embodiment, the width, Wu, of the upper portion is substantially the same as the width, Wl, of the lower portion 30 of the flat stack. The maximum width of the flat stack 20 is approximately equal to Wu+O. Equalizing the widths between Wu and Wl can be done by folding the sheets 22 along the longitudinal axis in the upper portion 29 with the same number of folds as the sheets in the lower portion 30. For example, the sheets 22 in both the upper portion 29 and lower portion 30 could be W-folded, Z-folded, or V-folded. In other embodiments, the width of the upper portion 29 and lower portion 30 can be different. For example, the upper portion 29 can be V-folded and the lower portion 30 J-folded such that Wl is greater than Wu.

In one embodiment, as best seen in FIG. 4A, the flat stack 20 contains individual tissue paper sheets 22 that are folded and interleaved for pop-up dispensing where withdrawing one sheet from the dispenser pulls at least a portion of the next sheet out of the dispenser for easier access to the next sheet. The upper portion 29 of the flat stack 20 includes a plurality of V-folded sheets having a leading panel 31 and a trailing panel 33 separated by a fold line 41. The leading panel 31 and trailing panel 33 are approximately equal in width. The V-folded sheets are interleaved, with the leading panel 31 of a subsequent sheet placed between the leading panel 31 and trailing panel 33 of a preceding sheet.

The lower portion 30 of the flat stack 20 includes a plurality of V-folded sheets having a leading panel 31 and a trailing panel 33 separated by a fold line 41. The leading panel 31 and trailing panel 33 are approximately equal in width. The V-folded sheets are interleaved, with the leading panel 31 of a subsequent sheet placed between the leading panel 31 and trailing panel 33 of a preceding sheet. At the interface between the upper portion 29 and the lower portion 30, the transition sheet 40 is J-folded with a shorter leading panel 31 and a longer trailing panel 33 to smoothly transition the offset distance O from the upper portion 29 to the lower portion 30. Desirably, the leading panel 31 is shortened by O/2 and the trailing panel 33 is lengthened by O/2. In this manner, the maximum surface area of the transition sheet 40 is in contact with both the upper portion 29 and the lower portion 30.

Referring to FIGS. 3B, 4B, and 2, after assembling the flat stack 20 of interfolded sheets 22, the flat stack is folded approximately 180 degrees about the stack transverse fold axis 28 adjacent the lower portion 30 to form a folded stack 34 having an arched stack top 36 and a stack bottom 37 comprising two opposing legs 38 located on opposite sides of the transverse fold axis 28 and extending there from. The folded stack 34 is then inserted into the oval dispenser 10 such that the transverse fold axis 28 is substantially parallel to the dispenser longitudinal axis 18 with the stack bottom 37 adjacent the dispenser bottom 14. In this embodiment, the upper portion 29 would be offset from the lower portion 30 instead of being reduced in width as shown in FIG. 3B.

As seen in FIG. 4B, this results in the folded stack 34 substantially filling out the length and width of the oval dispenser 10 without the folded stack 34 being unduly compressed by the oval dispenser's sidewall 16. Since the upper portion 29 and lower portion 30 of the folded stack 34 are offset, the folded stack 34 fills out the length of the oval dispenser 10, reducing wasted space at the opposing end portions of the oval dispenser. As a result of the offset distance, O, the thickness of the folded stack 34 is reduced near the smaller radius end portions of the oval dispenser 10, reducing the sidewall compression on the folded stack. The sidewall compression is particularly reduced while dispensing the initial sheets from the upper portion 29 since the edges 39 of the folded stack 34 having the fold lines 41 are compressed less. The upper portion 29 is offset such that at edges 39A, where both the upper and lower portions (29, 30) of the folded stack 34 are present, the edges 39A of the upper portion 29 are located closer towards the center portion of the oval dispenser where the dispenser's width is wider, reducing compression from the sidewall 16. At the edges 39B, where only the upper portion 29 is present, the sidewall compression is reduced even though the dispenser's width is smaller since the upper portion 29 can compress inwards into the void left in the middle of the folded stack 34 by the absence of the lower portion 30 that has been offset towards the other end of the dispenser. At the edges 39C, where only the lower portion 30 of the folded stack 34 is present, the overall thickness of the folded stack is significantly less since the upper portion 29 is not present, thereby reducing compression of the stack by the sidewall 16 even though the oval dispenser's width is smaller at this location. As such, improved dispensing occurs because the initial sheets in the folded stack 34 are compressed less by the sidewall 16.

For an oval shaped dispenser 10, the number of sheets in the upper portion 29 can be approximately equal to the number of sheets in the lower portion 30. In other embodiments, the upper portion 29 can contain either more sheets or fewer sheets than the lower portion 30. For example, the upper portion can contain from about 20 percent to about 80 percent of the total sheets in the flat stack 20. Alternatively, the upper portion 29 can contain from about 40 percent to about 60 percent of the total sheets in the flat stack 20, or the upper portion 29 can contain about 50 percent of the total sheets in the flat stack. If the oval dispenser 10 has a maximum length of approximately 5 and ⅞ inches and the sheets have an unfolded width of approximately 8.4 inches, the offset distance, O, can be approximately 1 inch such that the maximum width of the folded stack 34 is approximately 5.2 inches (8.4/2+1) along the carton's longitudinal axis 18. The offset distance, O, can be approximately 10 percent to approximately 60 percent of the width of the upper portion 29, Wu. Alternatively, the offset distance, O, can be approximately 20 percent to approximately 40 percent of the width of the upper portion 29, Wu.

Figure 5:
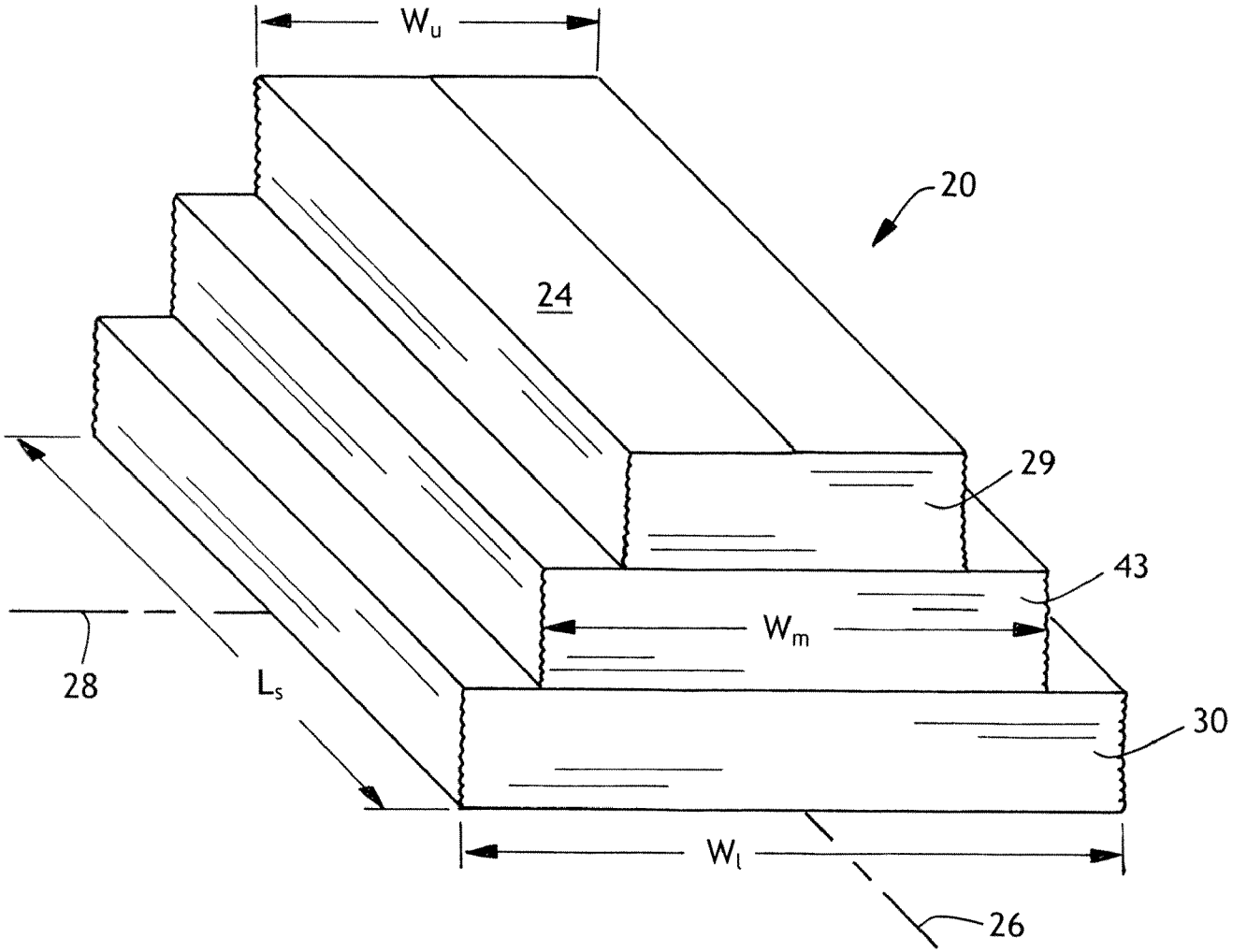
FIG. 5 is a perspective view of another embodiment of a stack containing a plurality of sheets formed from a sheet-material.
Figure 5A:
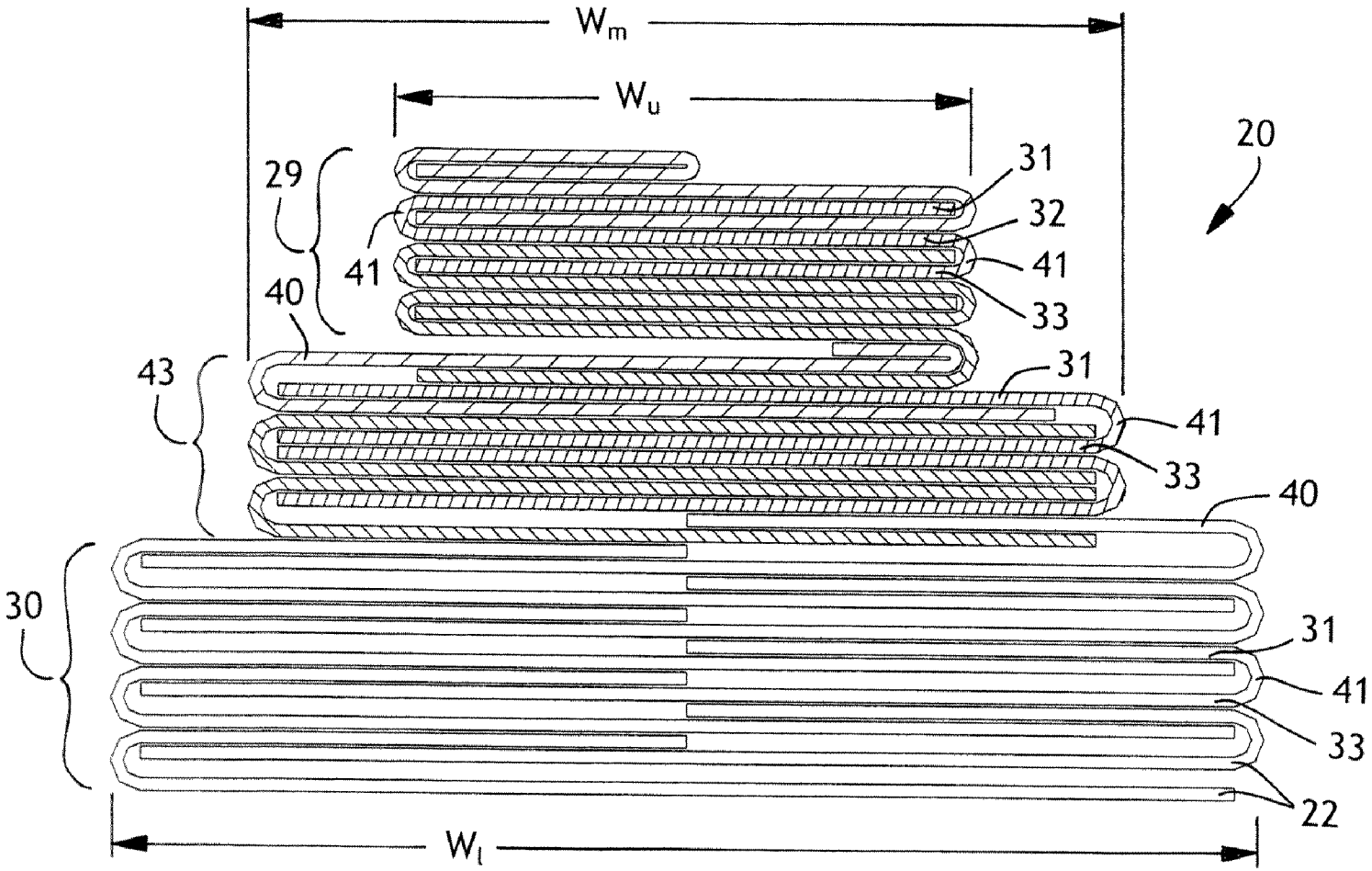
FIG. 5A is a partially exploded end view of the stack of FIG. 5 showing a fold configuration for the plurality of sheets.
Figure 5B:
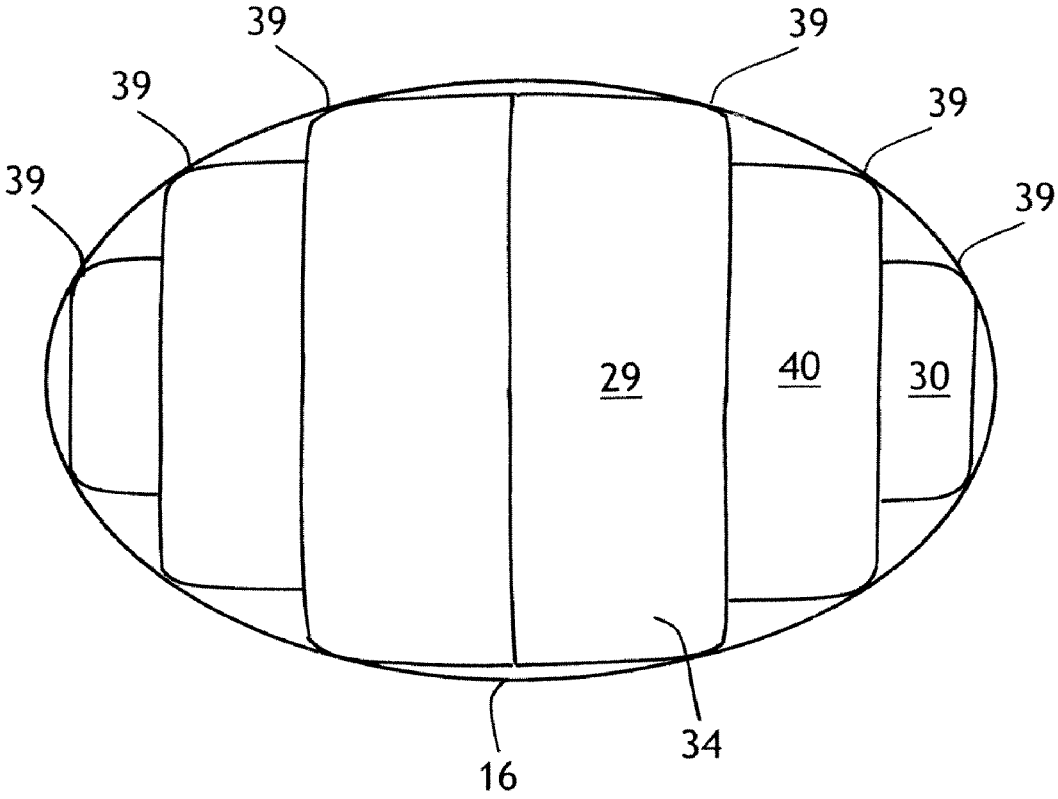
FIG. 5B is a top view of the sheet-material dispenser of FIG. 1 with the top removed and the stack of FIG. 5 folded about a transverse fold axis and inserted into the dispenser.

Referring now to FIGS. 5, 5A, and 5B, a flat stack 20 of a plurality of individual folded sheets 22 of a sheet-material 24, having substantially the same unfolded sheet width, is illustrated. The flat stack 20 has a substantially uniform maximum length, Ls, measured along a stack longitudinal axis 26, and a variable width, W, measured in the direction of a stack transverse fold axis 28. In particular, an upper portion 29 of the flat stack 20 has a smaller width, Wu, than a middle portion 43 of the flat stack. The middle portion 43 of the flat stack 20 has a smaller width, Wm, than a lower portion 30 of the flat stack having a width Wl. The difference in widths between Wu, Wm, and Wl can be created by folding the same width sheets 22 along the longitudinal axis such that the width of the sheets in each portion is different. For example, the sheets 22 in the upper portion 29 can be Z-folded, the sheets in the middle portion 43 can be V-folded, and the sheets in the lower portion 30 can be J-folded.

In one embodiment, as best seen in FIG. 5A, the flat stack 20 contained individual tissue paper sheets 22 that are folded and interleaved for pop-up dispensing. During pop-up dispensing, withdrawing one sheet from the dispenser pulls at least a portion of the next sheet out of the dispenser for easier access to the next sheet. In the illustrated embodiment, the upper portion 29 of the flat stack 20 includes a plurality of Z-folded sheets having a leading panel 31, a center panel 32, and a trailing panel 33 separated by two fold lines 41. The leading panel 31, center panel 32, and trailing panel 33 are approximately equal in width. The Z-folded sheets are interleaved, with the leading panel 31 of a subsequent sheet placed between the center panel 32 and the trailing panel 33 of a preceding sheet.

The middle portion 43 of the flat stack 20 includes a plurality of V-folded sheets having a leading panel 31 and a trailing panel 33 separated by a fold line 41. The V-folded sheets are interleaved, with the leading panel 31 of a subsequent sheet placed between the leading panel 31 and trailing panel 33 of a preceding sheet. The leading panel 31 and trailing panel 33 are approximately equal in width. At the interface between the upper portion 29 and the middle portion 43, the transition sheet 40 is Z-folded with a shorter leading panel 31, and longer center and trailing panels (32, 33) to smoothly transition from the upper Z-fold to the middle V-fold.

The lower portion 30 of the flat stack 20 includes a plurality of J-folded sheets having a leading panel 31 and a trailing panel 33 separated by a fold line 41. The J-folded sheets are interleaved, with the leading panel 31 of a subsequent sheet placed above and in contact with the trailing panel 31 of a preceding sheet. The sheets are J-folded with the leading panel 31 being shorter in width than the trailing panel 33. At the interface between the middle portion 43 and the lower portion 30, the transition sheet 40 is J-folded with a shorter leading panel 31, and a longer trailing panel 33 to smoothly transition from the middle V-fold to the lower J-fold.

Referring to FIGS. 3B, 5B, and 2, after assembling the flat stack 20 of interfolded sheets 22, the flat stack is folded approximately 180 degrees about the stack transverse fold axis 28, adjacent the lower portion, to form a folded stack 34 having an arched stack top 36 and a stack bottom 37 comprising two opposing legs 38 located on opposite sides of the transverse fold axis 28 and extending there from. The folded stack 34 is then inserted into the oval dispenser 10 such that the transverse fold axis 28 is substantially parallel to the dispenser longitudinal axis 18 with the stack bottom 37 adjacent the dispenser bottom 14. In this embodiment, an intermediate width middle portion 43 would be present in the folded stack 34 in addition to the upper portion 29 and lower portion 30 as illustrated in FIG. 3B.

As seen in FIG. 5B, this results in the folded stack 34 substantially filling out the interior length and width of the oval dispenser 10 without the folded stack 34 being unduly compressed by the oval dispenser's sidewall 16. Since the upper portion 29 of the folded stack 34 is narrower in width, it fills in the wider center section of the oval dispenser 10. The thickness of the folded stack 34 is reduced for the middle portion 43 and lower portion 30 near the narrower end portions of the oblong dispenser 10 thereby reducing compression while dispensing the initial sheets; especially at the edges 39 of the folded stack 34 where the fold lines 41 are located. Sheet-material that would have been excessively compressed at the edges 39 has been relocated to the wider sections of the oval dispenser. As such, improved dispensing occurs because the initial sheets in the folded stack 34 are compressed much less by the sidewall 16 when the same number and equivalent thickness sheets comprise the folded stack as opposed to an entirely V-folded interleaved folded stack.

It is believed one of the primary causes of sheet dispensing failures in dispensers containing folded stacks 34 is tearing of the initial sheets upon withdrawing them from the dispenser. Sheet tears are believed to occur by attempting to place too many sheets into the folded stack 34, thereby increasing its thickness such that it is significantly compressed by the sidewall 16 in order to fit into the oval dispenser. As such, increasing the size of the dispensing opening 42 or increasing the maximum height of the oval dispenser are not effective measures for reducing sheet tears.

As used herein, the interleaved distance is the contact distance measured in the width direction of a following sheet that touches one or more panels of a preceding sheet. Referring to FIG. 5A, the interleaved distance of the sheets 22 in the upper portion 29 is approximately equal to the width of the leading panel 31 or approximately equal to Wu. The interleaved distance of the sheets 22 in the middle portion 43 is approximately equal to the width of the leading panel 31 or approximately equal to Wm. As such, the interleaved distance varies from the upper portion 29 to the middle portion 43. In particular, the interleaved distance for the upper portion 29 is less than the interleaved distance for the middle portion 43. It is believed improved dispensing can occur by reducing the interleaved distance for the upper portion 29. By having less interleaved distance, it can be easier to remove a sheet from upper portion 29 when the folded stack 34 is placed into the dispenser 10. With too much interleaved distance, the compressive forces from the sidewall 16 acting on the folded stack 34 can cause the sheet to tear during removal from the dispenser. The total frictional force generated by the interleaved contact can exceed the tear strength of the sheet. By reducing the interleaved distance, sheet tears can be reduced while maintaining acceptable pop-up dispensing of the sheets 22 in the upper portion 29.

The optimum number of sheets for the upper, middle, and lower portions (29, 43, 30) of the flat stack 20 is related to the shape of the dispenser 10 and the sheet fold used for each portion. In the illustrated embodiment, the lower portion 30 is J-folded that results in a thickness of approximately 1.5 panels per sheet, the middle portion 40 is V-folded that results in a thickness of approximately 2 panels per sheet, and the upper portion is Z-folded that results in a thickness of approximately 3 panels per sheet. For a sheet width of approximately 8.4 inches and an oval dispenser 5 and ⅞ inches long by 3 and ⅞ inches wide, it is believed that the least sidewall compression occurs when the lower portion 30 contains approximately 44 percent of the total sheets, the middle portion 43 contains approximately 44 percent of the total sheets, and the upper portion 29 contains approximately 12 percent of the total sheets. Thus, in various embodiments of the invention, the upper portion 29 can contain from about 5 percent to about 20 percent of the total number of sheets in the flat stack 20, the middle portion 43 can contain from about 20 percent to about 60 percent of the total number of sheets in the flat stack 20, and the lower portion 30 can contain from about 20 percent to about 60 percent of the total number of sheets in the flat stack 20.

Referring now to FIGS. 6, 6A, 6B, and 6C, a flat stack 20 of a plurality of individual folded sheets 22 of a sheet-material 24 having substantially the same unfolded sheet width is illustrated. The flat stack 20 has a substantially uniform maximum length, Ls, measured along a stack longitudinal axis 26, and a variable width, W, measured in the direction of a stack transverse fold axis 28. In particular, an upper portion 29 of the flat stack 20 has a smaller minimum width, Wu, which gradually increases in width than a lower portion 30 of the flat stack. The difference in widths between Wu and W1 can be created by folding the same width sheets 22 along the longitudinal axis with an interleaved distance that is less than the width of the leading and trailing panels (31, 33) of the V-folded sheets contained in the upper and lower portions (29, 30).

Figure 6:
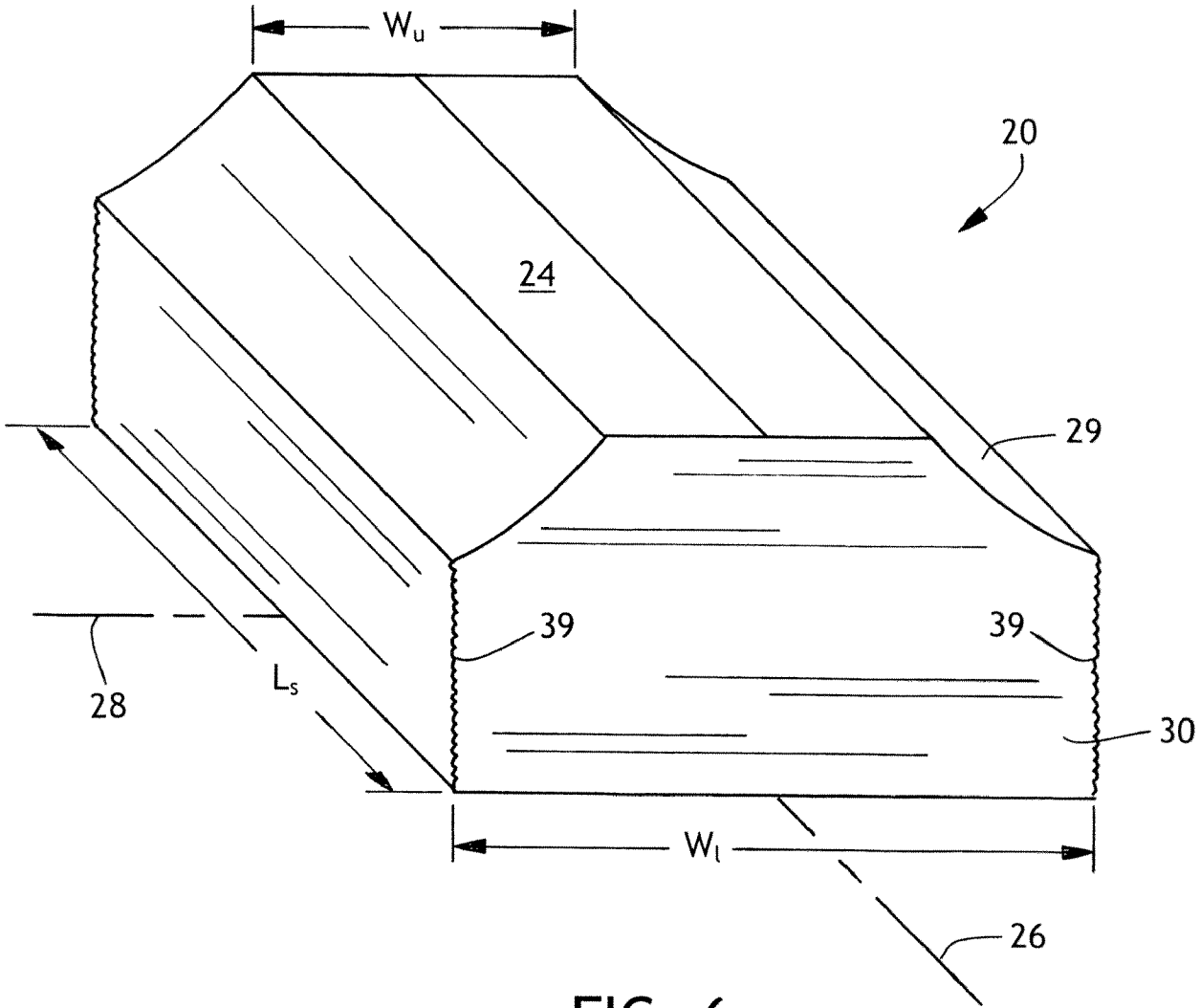
FIG. 6 is a perspective view of another embodiment of a stack containing a plurality of sheets formed from a sheet-material.
Figure 6A:
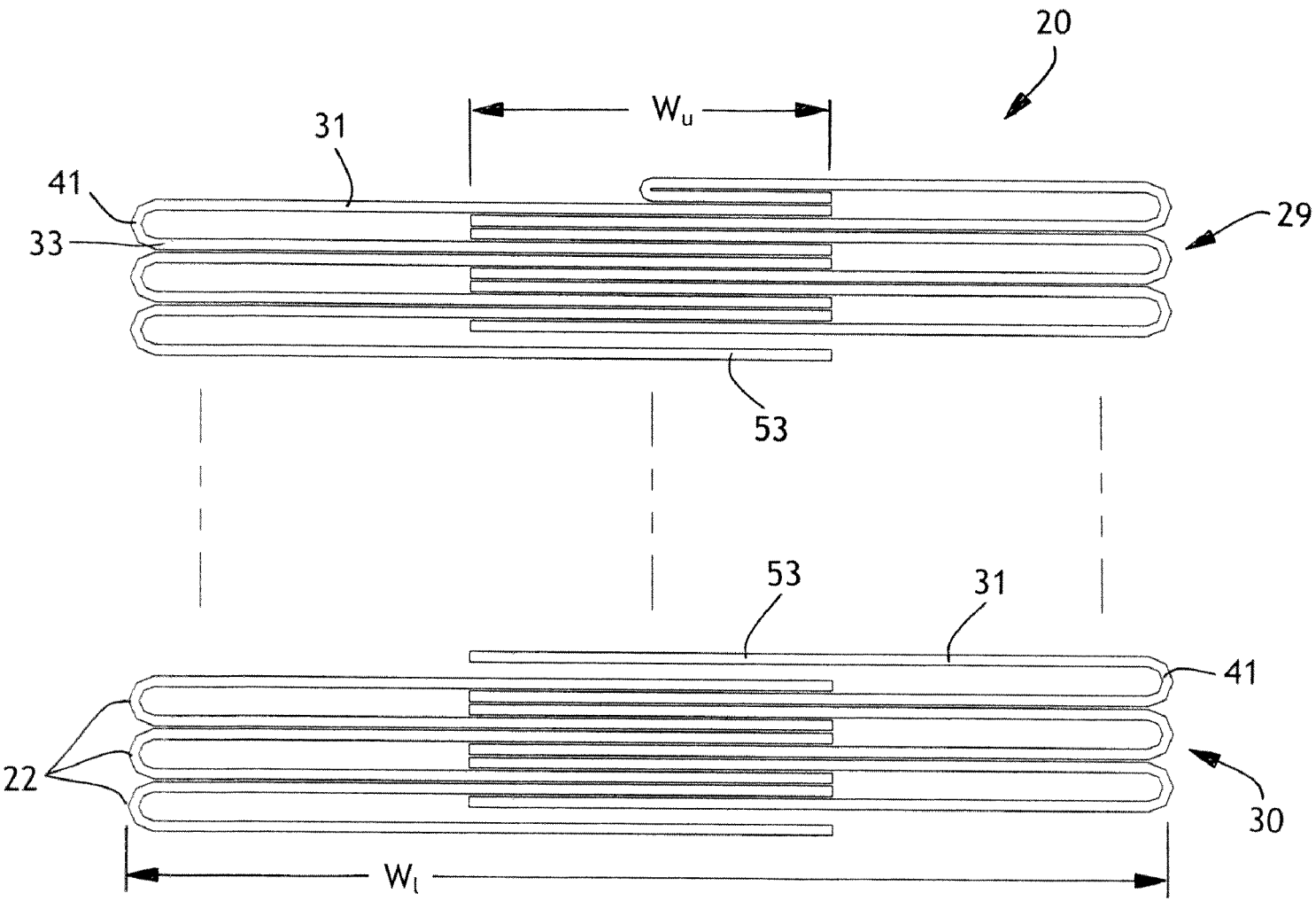
FIG. 6A is a partially exploded end view of the stack of FIG. 6 showing a fold configuration for the plurality of sheets.

In one embodiment, as best seen in FIG. 6A, the flat stack 20 contains individual tissue paper sheets 22 that are folded and interleaved for pop-up dispensing. During pop-up dispensing, withdrawing one sheet from the dispenser pulls at least a portion of the next sheet out of the dispenser for easier access to the next sheet. The upper and lower portions (29, 30) of the flat stack include a plurality of V-folded sheets having a leading panel 31 and a trailing panel 33 separated by a fold line 41. The V-folded sheets are interleaved, with the leading panel 31 of a subsequent sheet placed between the leading panel 31 and trailing panel 33 of a preceding sheet. The leading panel 31 and trailing panel 33 are approximately equal in width.

The sheets 22 are interleaved such that the interleaved distance is less than the width of the leading and trailing panels (31, 33). In the illustrated embodiment, the interleaved distance is approximately equal to Wu, which is approximately equal to ⅓ of the distance Wl. When the flat stack 20 contains a plurality of sheets 22, the center 53 of the flat stack, where the sheets are interleaved, becomes taller than the edges. The edges 39 of the flat stack 20 droop and compress since there are less individual tissue layers at the edges of the flat stack than there are individual tissue layers at the center 53 of the flat stack where it is interleaved. As such, the height of the edges 39 of the upper portion 29 of the flat stack 20 is not coincident with the height of the center portion 53.

Figure 6B:
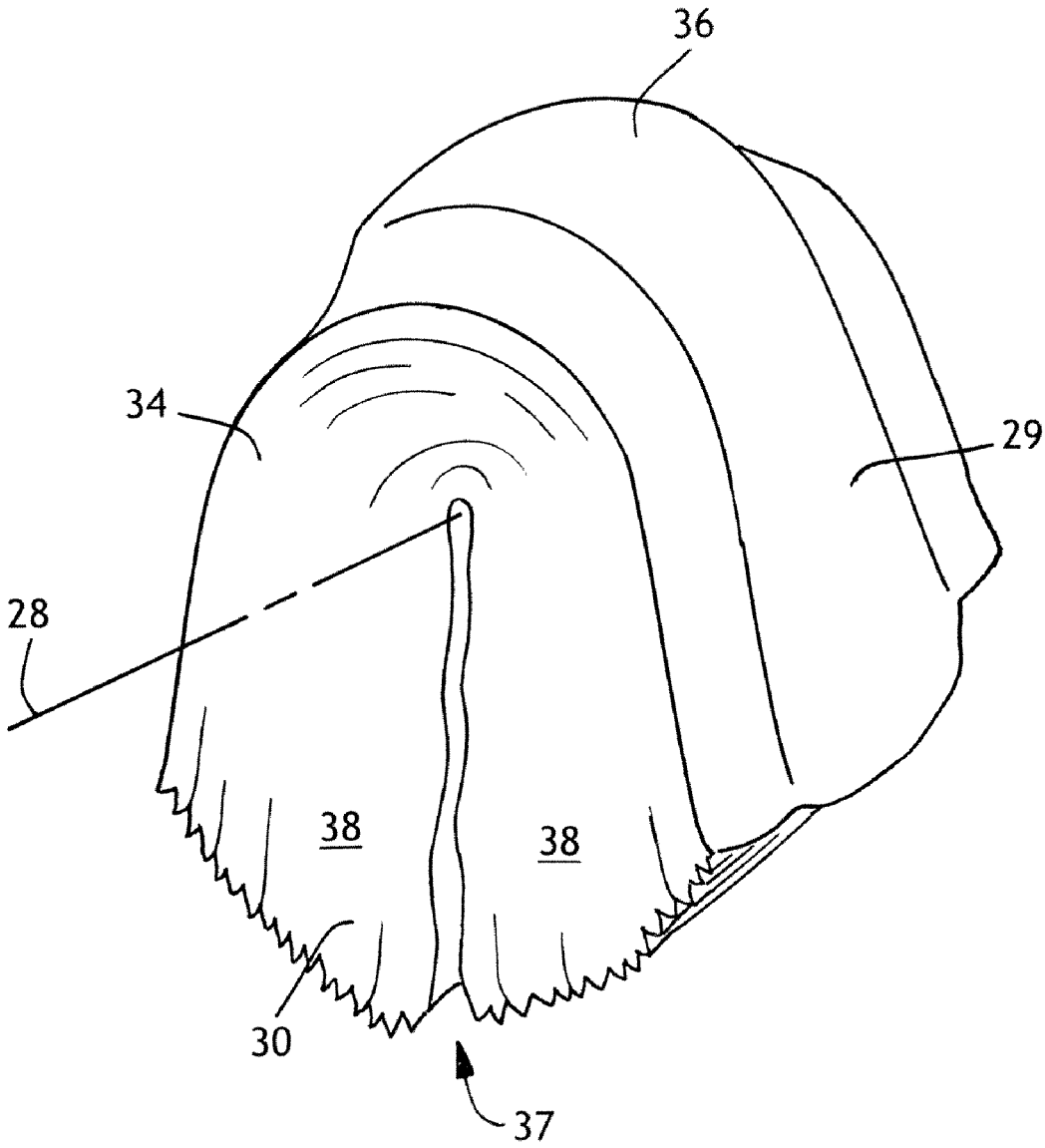
FIG. 6B is a perspective view of the stack of FIG. 6 folded about a transverse fold axis.
Figure 6C:
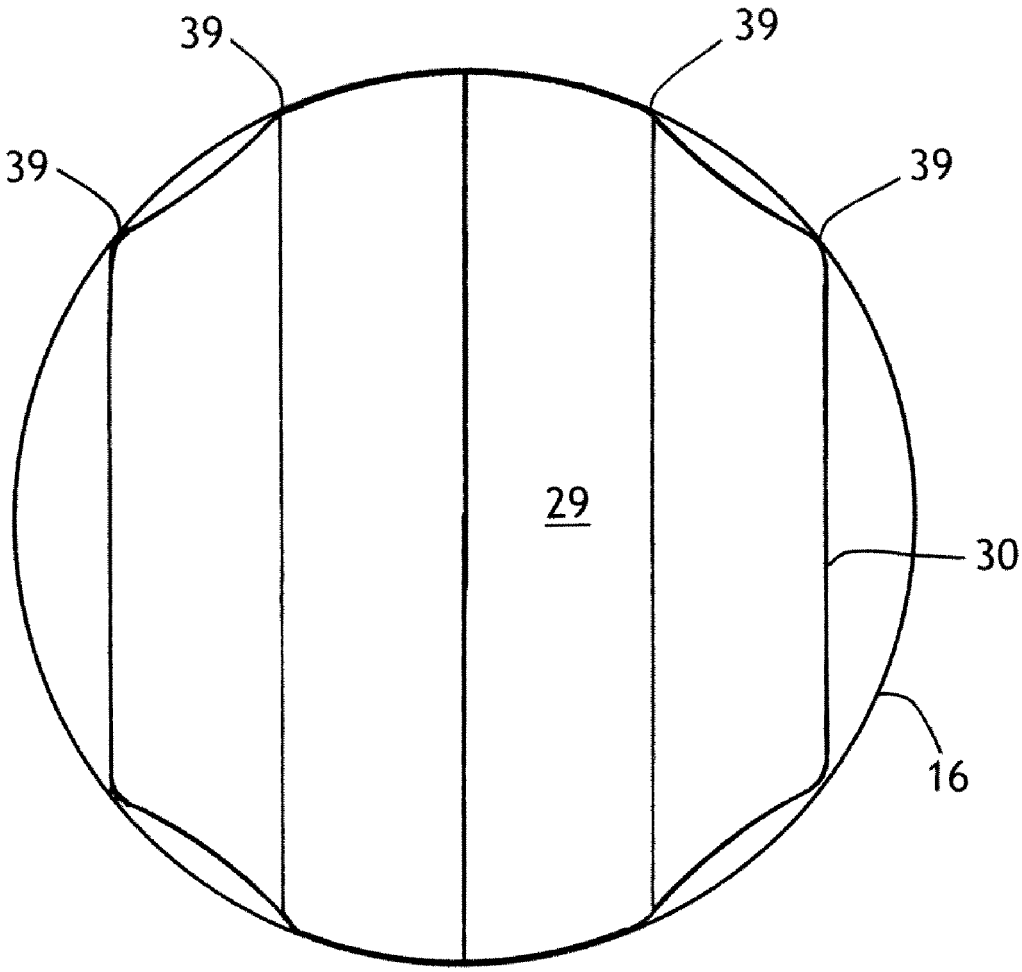
FIG. 6C is a top view of the folded stack of FIG. 6B inserted into a dispenser having a circular cross section.

Referring to FIGS. 6B and 6C, after assembling the flat stack 20 of interfolded sheets 22, the flat stack is folded approximately 180 degrees about the stack transverse fold axis 28, adjacent the lower portion 30 to form a folded stack 34 having an arched stack top 36 and a stack bottom 37 comprising two opposing legs 38 located on opposite sides of the transverse fold axis 28 and extending there from. The folded stack 34 is then inserted into a dispenser 10 having a circular sidewall 16. This results in the folded stack 34 substantially filling out the cross section of the circular dispenser 10 without the folded stack 34 being unduly compressed by the circular dispenser's sidewall 16.

Since the upper portion 29 of the folded stack 34 gradually increases in width due to the drooping edges 39, it helps to fill out more of the circular dispenser's cross section. Furthermore, since the edges 39 of the folded stack 34 have less individual tissue layers than the center 53, it is easier for the edges to bend and conform to the circular sidewall 16. Sheet-material that would have been excessively compressed at the edges 39 has been relocated to the center 53 of the folded stack 34. As such, improved dispensing occurs because the initial sheets in the folded stack are compressed much less by the sidewall 16.

Referring back to FIGS. 1 and 2, the oblong dispenser 10 can further include a dispensing opening 42, normally located in the top 12. Alternatively, the dispensing opening 42 can be optionally located partially in the sidewall 16 and in the top 12, or the dispensing opening can be placed in the bottom 14. Alternatively, the folded stack 34 can be inverted prior to being placed into the dispenser 10 with the folded stack bottom 14 adjacent to the top 12. The dispensing opening 42 can optionally include a dispensing window 44. The dispensing window 44 can be made from a suitable material such as a film, nonwoven, or paper material that can retain a partially dispensed sheet 22, such as a facial tissue, within the dispensing opening 42 for pop-up dispensing. The dispensing window 44 can have a dispensing orifice 45 that can be a slit; a curvilinear line; a geometric shape such as an oval, a circle, or a triangle; or X-shaped, +-shaped or H-shaped orifice. Alternatively, the dispensing window 44 can be eliminated and fingers or tabs projecting into the dispensing opening 42 can be used to retain a partially dispensed sheet 22.

The dispensing opening 42 can be any size or shape such as square, circular, or oval. The dispensing opening generally will be larger in size for a reach-in dispenser and smaller in size for a pop-up dispenser. The oblong dispenser 10 can further include an optional removable surfboard or cover 46 that can be attached to the dispenser 10 by a perforated or weakened line 47. The removable cover 46 can be used to prevent foreign materials from entering the filled dispenser and provides protection for the more fragile dispensing window 44 during loading and shipping. The oblong dispenser 10 can also include an optional film wrapper to further cover the dispensing opening 42 or outer portion of the dispenser. The film wrapper can be used to display printed information, such as a prominent trademark, size of the sheets, the number of sheets, or patent information, which can later be removed by the user so as to not detract from the graphic design of the dispenser.

The dispenser can be made from suitable materials that include, without limitation, cardboard, carton stock, paper board, polypropylene, polyethylene, polystyrene, ABS plastic, plastic, metal, wood, and glass, amongst other suitable alternatives.

In one embodiment, the oblong dispenser 10 included a formed oval sidewall 16 and bottom 14 made from carton stock or paperboard. The bottom 14 can be either recessed or even with the sidewall 16. The upper end of the sidewall 16 was folded over on the inside of the dispenser 10 to form an edge or lip. The dispenser 10 included a snap-in top 12, having an outer ring 48 formed from a plastic material that is molded around a paperboard center portion 54 containing the dispensing opening 42, optional clear poly film dispensing window 44, and optional removable cover 46. A flange on the outer ring 48 engages with the edge or lip on the interior of the sidewall 16 to secure the top 12 in place. If desired, the outer ring 48 can include a stacking lip 56 for use with a recessed bottom 14 to nest or interlock vertically stacked dispensers. Suitable snap-in tops and dispensers are disclosed in pending U.S. patent application U.S. 2006/131319 A1 published Jun. 22, 2006 entitled *Container Caps and Containers* by McDonald.

Alternative methods of constructing the oblong dispenser 10 can be used. For example, a carton blank or tube can be utilized. The carton blank can comprise a plurality of panels that are folded, assembled, and glued together to form a dispenser. A circular or other cross section shaped tube with plugs or caps can be used to construct the dispenser. Injection molding or thermoforming can be used to form the dispenser. Other techniques known to those of skill in the art can be utilized to make the dispenser 10.

In alternative embodiments of the invention, the flat stack 20 can comprise three, four, or more portions with each portion having a width that increases as you move from the top of the flat stack 20 to the bottom of the flat stack. Alternatively, the width of the folded sheets within the flat stack 20 may be made larger in stepwise increments or increase continuously and gradually from the top to the bottom of the flat stack.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising:

a flat stack of a plurality of interleaved V-folded sheets formed from a sheet-material, the flat stack having a variable width and a substantially uniform length, the flat stack having at least an upper portion and a lower portion, wherein the upper portion of the flat stack has a width, Wu, and the lower portion of the flat stack has a width, WI, which is approximately equal to Wu, wherein the upper portion of the stack contains from 6 to 30 folded sheets and wherein the upper portion is offset from the lower portion by an offset distance 0 which is from about 10 percent to about 60 percent of the width Wu; and the flat stack folded about a transverse fold axis adjacent the lower portion to form a folded stack having an arched stack top and a stack bottom comprising two legs; and a dispenser comprising: an oval-shaped top, an oval-shaped bottom and a sidewall; a dispensing opening located in the top; and wherein the dispenser is oblong having a longitudinal axis and having a maximum width, Wd, that is less than the maximum length, Ld;

wherein the folded stack is placed into the dispenser with the transverse fold axis of the folded stack substantially parallel to the longitudinal axis of the dispenser and with the arched stack top adjacent to the dispensing opening.

2. The product of claim 1 wherein the sheets in the upper portion are Z-folded and the sheets in the lower portion are V-folded.

3. The product of claim 2 wherein the ratio of the number of sheets in the upper portion to the number of sheets in the lower portion is about 0.19.

4. The product of claim 1 wherein the flat stack further comprises a middle portion having a width, Wm, wherein Wu is less than Wm, and Wm is less than WI.

5. The product of claim 4 wherein the sheets in the upper portion are Z-folded, the sheets in the middle portion are V-folded, and the sheets in the lower portion are interleaved and J-folded.

6. The product of claim 4 wherein the upper portion and the middle portion each have an interleaved distance, and the interleaved distance for the upper portion is less than the interleaved distance for the middle portion.

7. The product of claim 1 wherein the upper portion contains from about 0.5 percent to about 25 percent of the total number of sheets in the flat stack.

8. The product of claim 1 wherein the ratio of the number of sheets in the upper portion divided by the number of sheets in the lower portion is about 0.19.

9. The product of claim 1 wherein the interleaved distance of the upper and lower portions is about ⅓ of the distance WI.

10. The product of claim 1 wherein the number of sheets in the upper portion of the stack is from 8 to 20.

* * * * *